US012163393B2

(12) United States Patent
Davison et al.

(10) Patent No.: US 12,163,393 B2
(45) Date of Patent: Dec. 10, 2024

(54) MULTI-FUNCTION MANDREL SYSTEM

(71) Applicant: Tally USA, LLC, Houston, TX (US)

(72) Inventors: Douglas Wayne Davison, Tomball, TX (US); Shane Allen Davison, Tomball, TX (US)

(73) Assignee: Tally USA, LLC, Houston, TX (US)

( * ) Notice: Subject to any disclaimer, the term of this patent is extended or adjusted under 35 U.S.C. 154(b) by 0 days.

(21) Appl. No.: 17/231,804

(22) Filed: Apr. 15, 2021

(65) Prior Publication Data

US 2021/0324695 A1 Oct. 21, 2021

Related U.S. Application Data

(60) Provisional application No. 63/010,274, filed on Apr. 15, 2020.

(51) Int. Cl.
*E21B 23/10* (2006.01)
*E21B 23/06* (2006.01)

(52) U.S. Cl.
CPC ..... *E21B 23/10* (2013.01); *E21B 23/06* (2013.01); *E21B 2200/04* (2020.05)

(58) Field of Classification Search
CPC ..... E21B 23/06; E21B 23/10; E21B 23/04; E21B 34/14; E21B 34/142; E21B 33/134; E21B 23/0413
See application file for complete search history.

(56) References Cited

U.S. PATENT DOCUMENTS

| | | | | |
|---|---|---|---|---|
| 2,981,335 | A * | 4/1961 | Bucy | E21B 33/068 15/104.062 |
| 4,031,957 | A * | 6/1977 | Sanford | E21B 43/25 166/264 |
| 6,732,793 | B1 * | 5/2004 | Lee | E21B 21/103 175/313 |
| 6,848,511 | B1 * | 2/2005 | Jones | E21B 33/16 166/386 |
| 9,702,221 | B2 * | 7/2017 | Hofman | E21B 34/14 |
| 2017/0089159 | A1 * | 3/2017 | Sullivan | E21B 43/08 |
| 2019/0106964 | A1 * | 4/2019 | Strohla | E21B 34/14 |

* cited by examiner

*Primary Examiner* — D. Andrews
(74) *Attorney, Agent, or Firm* — Park, Vaughan, Fleming & Dowler LLP

(57) ABSTRACT

A multi-function mandrel system that is used for setting downhole devices and for capturing restriction elements while downhole as opposed to having to flow back restricted elements to surface.

31 Claims, 5 Drawing Sheets

MULTI-FUNCTION MANDREL SYSTEM

CROSS-REFERENCE TO RELATED APPLICATIONS

The current application claims priority to U.S. Provisional Patent Application 63/010,274, dated Apr. 15, 2020, the entirety of which is incorporated by reference.

FIELD OF THE DISCLOSURE

Aspects of the disclosure relate to recovery of hydrocarbons from strata. More specifically, aspects of the disclosure relate to a multi-function mandrel system used in the recovery of hydrocarbons from geological stratum

BACKGROUND

Many tools are used to recover hydrocarbons, such as oil and gas, from geological stratum. Each tool may perform a specialized function that is required by well drillers. At times, actuation of downhole apparatus is achieved through dropping a steel ball into the wellbore, wherein the steel ball falls through gravity down to a device configured to receive the dropped ball. In addition to such conventional apparatus, actuation of downhole apparatus can occur through other numerous different techniques and methods. Electric actuators may be used to actuate systems that are fed a continuous supply of electricity, as an example. Other means of actuation require less complexity and use the inherent environment to allow the downhole systems to accomplish their function.

As wellbores are drilled, cuttings from the drill bit must be flushed from the wellbore in order to allow the wellbore to continue seeking new depths. The flushing action occurs through pumping of fluids down a casing of a drill pipe, and then the return of the drilling fluid to an up-hole environment after passing through an annulus. To accomplish this, fluid is stored in a reservoir and then pumped through fluid pumps to the downhole environment.

Operators seek to have a foolproof way in which actuation of different types of systems may be actuated. As mentioned previously, one such way is to use gravity as a motive force in which a dropped object, such as a ball, is placed into a wellbore casing to eventually impact a receiving apparatus. Once the ball impacts the receiving apparatus, and the receiving apparatus is actuated, the ball has accomplished its goal and is no longer needed.

Conventional activities allow the ball to flow up-hole during production operations. Several problems are encountered using this conventional approach. For example, the ball may get stuck near the up-hole environment and become a plug to operation. To continue operation, the ball is required to be removed or drilled, costing valuable rig time. Moreover, the ball may impact different "trees" or valves in the up-hole environment, potentially causing damage to pressure boundaries that are required to be maintained.

In embodiments, certain aspects of normal drilling activity are challenging for operations. One such aspect is the ability of perforating guns to actuate and puncture casing within the wellbore. In some aspects, the activity and viability of the perforating gun cannot be guaranteed. To this end, at times, perforating guns can fail to perform their required functionality. In instances where the perforating gun does not fire, the operator is forced to retrieve the perforating guns and hydraulically pump new gun system in the horizontal wellbore. In instances where conventional hydraulic fracturing plugs are used, deploying new guns is not possible without additional difficult steps being taken. Conventional hydraulic fracturing plugs, for example, have an installed flow ball on seat that limits fluid flow past the hydraulic plug, thereby limiting the ability to pump down new guns The conventional method is to flow ball back to surface with risk of not being able to recover based on wellbore flow limitations.

There is a need to provide apparatus and methods that are easier and more reliable to operate than conventional apparatus and methods involving ball on seat systems.

There is a further need to provide apparatus and methods that do not have the drawbacks discussed above, such as stuck balls or balls that must be drilled out from a hydrocarbon flow path.

There is a still further need to reduce economic costs associated with operations and apparatus described above with conventional tools and required rework with ball on seat operations.

There is a still further need to provide a system and method to allow reliable ball recovery to allow perforating gun deployment without the drawbacks of conventional systems and methods.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, a mandrel is disclosed, comprising: a first section, a second section and a tapered section joining the first section and the second section, wherein the first section, the second section and the tapered section are hollow and configured to accept a restriction element. The mandrel further comprises an insert placed at an angle within the second section having an insert configured to extend from a compressed configuration to an uncompressed configuration, and wherein in the uncompressed configuration, a portion of the insert projects into the second section such that a the restriction element is retained within the second section, and in a compressed configuration, the wellbore restriction element is not retained within the second section.

In a further embodiment, a mandrel is disclosed comprising a body comprising: a first section with at least one through hole allowing a fluid to pass from an interior of the first section to an exterior of the first section; a second section having a restriction element seat and having at least one through hole allowing a fluid to pass from an interior of the second section to an exterior of the second section and a tapered section joining the first section and the second section, wherein the first section, the second section and the tapered section are hollow and configured to accept a restriction element. The mandrel may further comprise an insert placed at an angle within the second section, wherein the insert is configured to extend from a compressed configuration to an uncompressed configuration and wherein in the uncompressed configuration, a portion of the insert projects into the second section such that the restriction element is retained within the second section, and in a compressed configuration, the restriction element is not retained within the second section.

In another example embodiment, a method of operation for a mandrel is disclosed comprising: dropping a restriction element to activate a downhole system; starting a flow back of fluid within a wellbore sufficient to cause the restriction element to move toward an up-hole environment, compressing a spring-loaded insert placed within a second portion of the mandrel such that the restriction element passes along a diameter of the mandrel past the spring-loaded insert; uncompressing the spring-loaded insert placed within the second portion of the mandrel such that the restriction element returns to an uncompressed state, and trapping the restriction element within the second portion of the mandrel between a seat and the uncompressed spring-loaded insert.

In another example embodiment, an apparatus is disclosed. The apparatus may comprise an arrangement configured with a central portion that is configured to allow a fluid to pass through the arrangement and wherein the arrangement is configured to be installed within a plug head adapter, wherein the arrangement is expandable from a first unexpanded position to a second expanded position.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure, and are therefore not be considered limiting of its scope, for the disclosure may admit to other equally effective embodiments.

Figure 1:
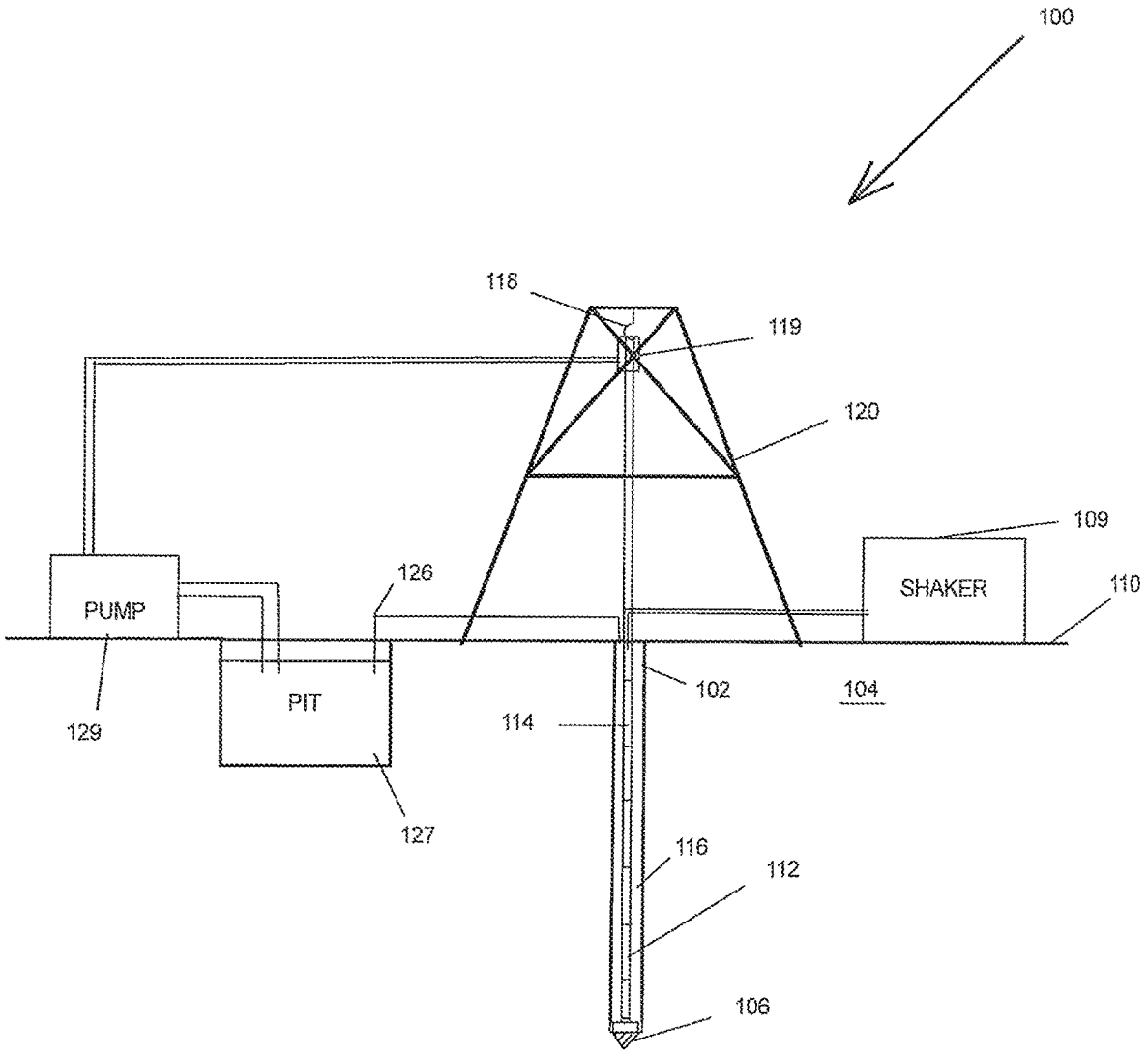
FIG. 1 is a drill rig performing a hydrocarbon recovery operation in one aspect of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is riot limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and shall not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Referring to FIG. 1, a drilling rig 100 is illustrated. The drilling rig 100 is configured to recover hydrocarbons located in geological strata beneath the surface 110. As illustrated, different stratum 104 may be encountered during the creation of a wellbore 102 wherein a single stratum 104 layer may be encountered. As will be understood, multiple layers of stratum 104 may also be encountered, therefore a single layer should not be considered limiting. In embodiments, the stratum 104 may be horizontal layers or vertical columns. In still further embodiments, the stratum 104 may have both horizontal and vertical layers. Stratum 104 beneath the surface 110 may be varied in composition, and may include silt, sand and clay as well as rock and/or combinations of these. Operators, therefore, in order to progress the wellbore 102 need to assess the composition of the stratum 104 in order to maximize the penetration of a drill bit 106 that will be used in the drilling process.

Pressure is placed on a drill bit 106 such that the drill bit 106 is urged into the stratum 104. In embodiments, the drill bit 106 is rotated such that contact between the drill bit 106 and the stratum 104 causes portions ("cuttings") of the stratum 104 to be loosened at the sides and the bottom of the wellbore 102. According to the different types of stratum 104 encountered, differing types of drill bits 106 may be used to enhance penetration rates into the stratum 104. The types of stratum 104 encountered, therefore, is an important characteristic for operators. In some embodiments, roller cone bits, diamond impregnated or hammer bits may be used. In some embodiments, polycrystalline diamond compact ("PDC") drill bits may be used. In embodiments, during the drilling process, vibration may be placed upon the drill bit 106 to aid in the breaking of stratum 104 that are encountered by the drill bit 106. Such vibration may increase the overall rate of penetration ("ROP"), increasing the efficiency of the drilling operations.

As the wellbore 102 extends further into the stratum 104, operators may add portions of drill string pipe 114 to form a drill string 112. The drill string 112 may be comprised of a number of different components, described later. As illustrated in FIG. 1, the drill string 112 may extend into the stratum 104 in a vertical orientation. In other embodiments, the drill string 112 and the wellbore 102 may deviate from a vertical orientation, In some embodiments, the wellbore 102 may be drilled in certain sections in a horizontal direction, parallel with the surface 110, The geometry of the wellbore 102, therefore, may be quite complex to reach a section of stratum 104 that contains hydrocarbon reserves.

In order to make an annulus around the drill string 112, the drill bit 106 is larger in diameter than the drill string 112. This annular space provides a pathway for removal of cuttings from the wellbore 102. Drilling fluids include water and specialty chemicals to aid in the formation of the wellbore 102. Other additives, such as defoamers, corrosion inhibitors, alkalinity control, bactericides, emulsifiers, wetting agents, filtration reducers, flocculants, foaming agents, lubricants, pipe-freeing agents, scale inhibitors, scavengers, surfactants, temperature stabilizers, scale inhibitors, thinners, dispersants, tracers, viscosifiers, and wetting agents may be added.

The drilling fluids may be stored at the drill site. In one example embodiment, a pit 127 is located at the drill site. In one non-limiting embodiment, the pit 127 may have a liner to prevent the fluids from potentially entering surface groundwater and/or contacting surface soils. In other embodiments, the drilling fluids may be stored in a tank alleviating the need for a pit 127. The pit 127 may have a recirculation line 126 that connects the pit 127 to a shaker 109 that is configured to process the drilling fluid after progressing from the downhole environment. The tank may be a self-contained unit and may be stationary or mobile.

Drilling fluid from the pit 127 is pumped by a mud pump 129 that is connected to a swivel 119. The drill string 112 is suspended by a drive 118 from a derrick 120. In the illustrated embodiment, the drive 118 may be a unit that sits atop the drill string 112 and is known in the industry as a "top drive". The top drive 118 is configured to provide the rotational motion of the drill string 112 and attached drill bit 106. Although the drill string 112 is illustrated as being rotated by a top drive 118, other configurations are possible. A rotary drive located at or near the surface 110 may be used by operators to provide the rotational force. Power for the rotary drive or the top drive 118 may be provided by diesel generators.

Drilling fluid is provided to the drill string 112 through a swivel 119 suspended by the derrick 120. The drilling fluid exits the drill string 112 at the drill bit 106 and has several functions in the drilling process. The drilling fluid is used to cool the drill bit 106 and remove the cuttings generated by the drill bit 106. The drilling fluid with the loosened cuttings enter the annular area outside of the drill string 112 and travel up the wellbore 102 to a shaker 109. The drilling fluid provides further information on the stratum 104 being encountered and may be tested with a viscometer, for example, to determine formation properties. Such formation properties allow engineers the ability to determine if drilling should proceed or terminate.

The shaker 109 is configured to separate the cuttings from the drilling fluid. The cuttings, after separation, may be analyzed by operators to determine if the stratum 104 currently being penetrated has hydrocarbons stored within the stratum 104 level that is currently being penetrated by the drill bit 106. The drilling fluid is then recirculated to the pit 127 through the recirculation line 126. The shaker 109 separates the cuttings from the drilling fluid by providing an acceleration of the fluid on to a screening surface. As will be understood, the shaker 109 may provide a linear or cylindrical acceleration for the materials being processed through the shaker 109. In embodiments, the shaker 109 may be configured with one running speed. In other embodiments, the shaker 109 may be configured with multiple operating speeds. In embodiments, the shaker 109 may operate at multiple operating speeds.

As will be understood, smaller cuttings may pass entirely through the screens of the shaker 109 such that the fluids may include many smaller size cuttings. The overall quality of the drilling fluid, therefore, may be compromised by such smaller cuttings. The drilling fluid may be, as example, water based, oil based or synthetic based types of fluids. The fluid provides several functions, such as the capability to suspend and release cuttings in the fluid flow, the control of formation pressures (pressures downhole), maintain wellbore stability, minimize formation damage, cool, lubricate and support the bit 106 and drilling assembly, transmission of energy to tools and the bit 106, control corrosion and facilitate completion of the wellbore. In embodiments, the drilling fluid may also minimize environmental impact of the well construction process.

Figure 2:
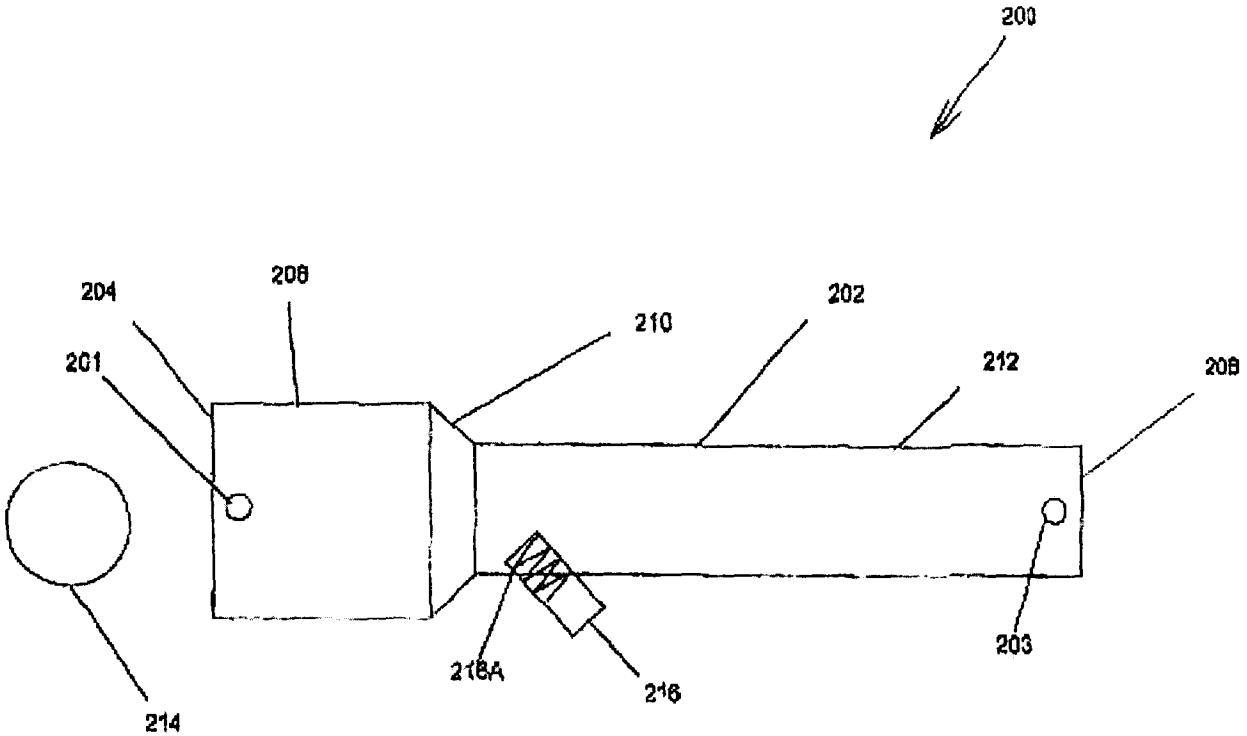
FIG. 2 is a side elevational view of a mandrel with ball catching mechanism, in conformance with one example embodiment of the disclosure.

Referring to FIG. 2, a mandrel 200 is illustrated in one non-limiting embodiment of the disclosure. The mandrel 200 may have different functions such as for setting downhole tools or releasing downhole tools from set positions. The mandrel 200 is configured, in the illustrated embodiment, to be used during hydraulic fracturing operations in one non-limiting embodiment. In other embodiments, the mandrel 200 may be used in downhole environments that require an actuation to occur.

In fracturing, a low permeability reservoir may be stimulated to cause hydrocarbons to flow to a desired point. Fluids that have been designed to be pumped to a specified downhole location are prepared at the surface and then pumped to a sectioned off portion of a wellbore. The wellbore may be sectioned off by hydraulic fracturing plugs that prevent flow out of the specified section. By pumping the fluids down to this portion of the wellbore, a localized over-pressuring occurs, fracturing the rock and solids. The amount and size of the fracture are according to the pressures applied to the stratum at that location. Materials may be added to the process, called proppant, to aid in the stimulation. The proppant, similar to grains of sand, prevent re-closure of the fracture that has been created, allowing the hydrocarbons to flow into the developed fractures. Through these measures, a high-conductivity communication is developed to the hydrocarbon zone allowing hydrocarbons to flow to a less pressurized area (wellbore) and ultimate transportation to the surface.

Figure 3:
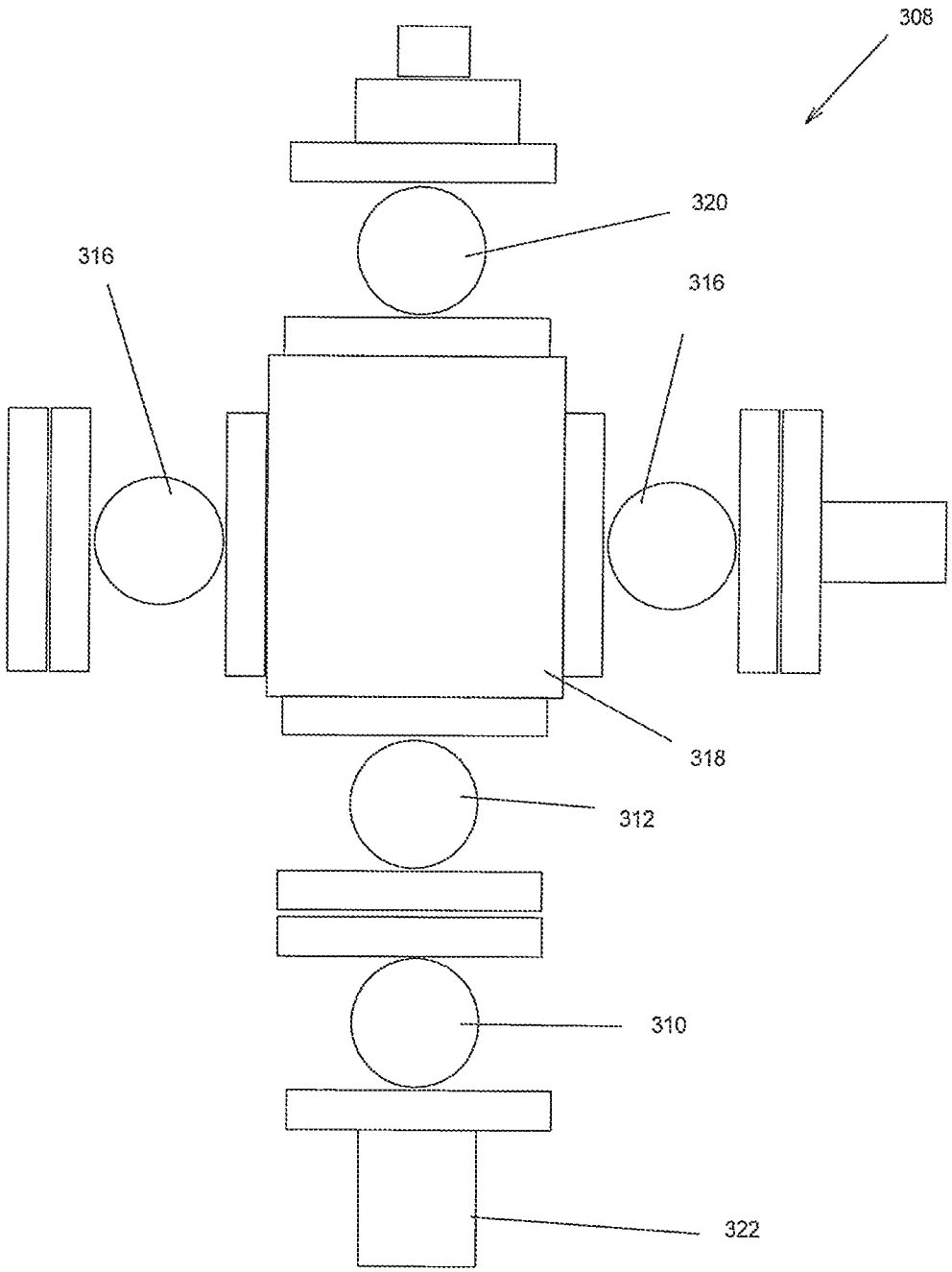
FIG. 3 is a elevational view of a hydraulic fracturing tree used up-hole from the mandrel.

Referring to FIG. 3, to aid the pumping of fluids to the downhole environment, a fracturing tree 308 is used to pump the desired materials to downhole environment. The fracturing tree 308 may have different configurations according to the pressure, fracturing requirements for the stratum 104, cost, amounts of proppant and other features. In a typical embodiment, the hydraulic fracturing tree 308 may consist of a lower valve 310, an upper valve 312, a flow cross/goat head 318, wing valves 316 and swab valve 320. The goat head 318 allows for mixing capability of fluids emanating from different size fluid delivery systems. Thus, the fracturing tree 308 has several ports into which fluids, solids and other materials may be combined and then placed into the downhole environment. A tubing head adapter 322 is also provided.

The fracturing tree 308 is a sensitive piece of equipment that must not be damaged as the fracturing tree 308 is used to maintain pressure for both the fracturing tree 308 and the downhole wellbore 102. Degradation of the fracturing tree 308 should be prevented as environmental consequences may occur if components are damaged, Degradation may occur if a fracturing ball used in setting operations is allowed to flow up-hole and hit the fracturing tree 308 internally.

To achieve a successful hydraulic fracturing operation, a traditional composite plug contains a mandrel, upper slip/cone, element, and lower slip/cone. The mandrel of the plug provides a structure upon which the other components operate. These components slide or "ride" on the mandrel, The upper slip/cone and lower slip/cone elements will move along the mandrel. The mandrel may have specifically manufactured groove or apparatus to allow for the engagement and disengagement of the upper slip/cone and lower slip/cone. The upper slip/cone and lower slip/cone go from an unexpanded position to an expanded position, wherein in the expanded position, the hydraulic fracturing plug engages the wall of the wellbore and provides a fluid tight, seal. The slips are designed to interact with a cone structure such that when the slips and the cone are forced together the slips move outward to engage the casing. In certain embodiments, the slips have portions that are hardened and designed to "bite" into the casing, locking the slip in place along the casing.

For a plug, designed to only hold pressure from above, in different embodiments, the lower slip may be designed to hold the full force of the hydraulic fracturing operation, and the upper slip will be designed to keep the plug, mainly the element, compressed after setting. An element is designed to compress under the setting force creating a seal between the ID of the casing wall and the mandrel. This seal provides the isolation so that the zone above can be treated discretely. For a ball drop plug, a ball will be dropped from the surface to land on the mandrel and activate the plug.

Embodiments of the disclosure allow for a mandrel that is hollow to allow for passage of a dropped ball so that the dropped bail may not travel back up-hole and impact the tree.

Aspects of the disclosure also provide methods that may be performed to achieve a stated goal, including controlling components described in the specification. In some embodiments, the methods described may be performed by circuits and/or computers that are configured to perform such tasks.

Referring to FIG. 2, the mandrel 200 has a body 202 that has a first end 204 and a second end 206. In the illustrated embodiment, the body 202 has a first section 208, a tapered section 210 and a second section 212. In this embodiment, the tapered section 210 connects the first section 208 to the second section 212. In one embodiment, the first section 208, the tapered section 210 and the second section 212 are hollow bodies. The body 202 is configured such that a dropped ball 214 passes through the first end 204 and the first section 208 and passes through the tapered section 210 into the second section 212 of the body 202. To prevent the ball 214 from passing back through the entire second section 212, an arrangement 216 with a spring loaded insert 216A is positioned at an angle from the longitudinal axis of the body 202. Under flow back conditions, the dropped ball 214 is not allowed to pass through the second section 212 as the button of the spring loaded insert 216A extends partially into the flow path. The dropped ball 214 may be defined as a restriction element that restricts flow of fluid with the channel, tube or conveyance that the ball 214 is placed. A seat 205 is provided for capturing the ball 214. At least four holes 201 are provided in the first section 208. At least four holes 203 are provided in the second section 212. In the illustrated embodiment, the spring loaded insert 216A is in an expanded position. When the ball 214 contacts the spring loaded insert from the left side, the insert 216A may compress to an unexpanded position.

The spring loaded insert 216A is angled such that the dropped ball 214 may compress the spring portion of the spring loaded insert 216A during flow back. After passing past the spring loaded insert 216A into the second section 212 of the body 202, any attempt by the dropped ball 214 from passing back out into the tapered section 210 of the body 202 is prevented as the button of the spring loaded insert 216A projects into the diameter opening of the second section 212 sufficiently such that the remaining diameter of opening is less than the outer diameter of the dropped ball 214. Aspects of the disclosure provide a superior configuration to conventional ball retaining techniques because the spring loaded insert 216A is much more robust than conventional apparatus. For example, conventional apparatus that use a cantilevered spring arrangement are permanently within the flow path and opening of the body 202. Such configurations can result in a bent cantilevered arrangement if the ball 214 hits the cantilever arrangement with sufficient force. In the aspects of the disclosure presented herein, the spring-loaded insert 216A has sufficient robustness such that the dropped ball 214 impacting at full velocity does not exceed the yield strength of the material placed in the spring-loaded insert 216A. Moreover, aspects of the disclosure provide for different types of spring-loaded inserts 216A to be used within the body 202. Thus, if a dropped ball 214 is to be of a smaller size, the main body 202 of the mandrel 200 can still be used, but rather the spring loaded insert 216A can be repositioned such that more projection of the button into the open diameter of the body 202 is attained. Conventional apparatus do not provide this type of arrangement wherein the cantilever arrangement is affixed to the inside diameter of the body 202. If a different diameter ball 214 is to be used, then the entire body and cantilever arrangement cannot be used, as the ball 214 can pass through the remaining opening in the cantilever arrangement. Thus, by using aspects of the disclosure provided herein, a single body 202 may be used and a number of different spring-loaded inserts 216A can be field installed. The reduction of the number of mandrels to be used in the simplification of the process for dropping balls is achieved compared to conventional apparatus. A restriction element seat may be provided to allow for seating of the restriction element within the body 202. In one embodiment, the first section 208 is configured with at least one through hole allowing a fluid to pass from an interior of the first section 208 to an exterior of the first section 208. The second section 212 may also be configured with at least one through hole allowing a fluid to pass from an interior of the second section 212 to an exterior of the second section 212.

Figure 4:
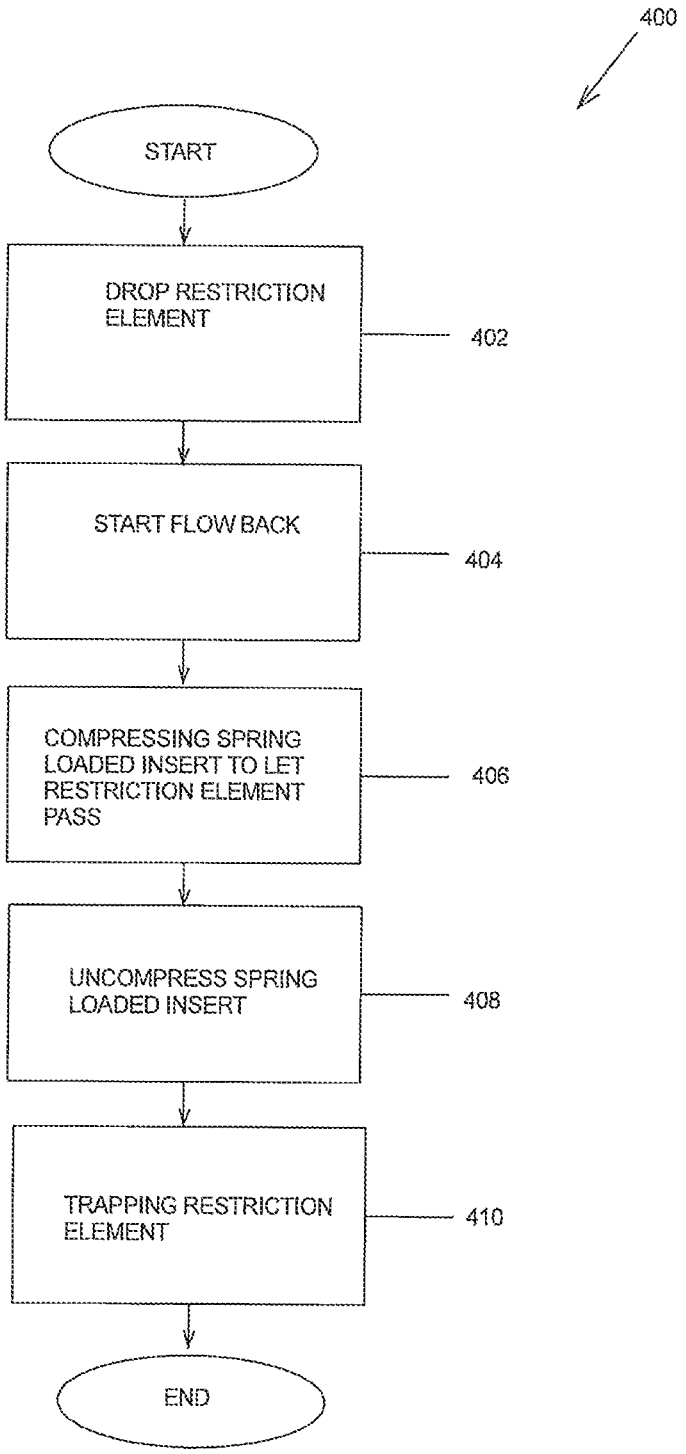
FIG. 4 is a method of operation of mandrel of FIG. 2 in one non-limiting embodiment of the disclosure.

Referring to FIG. 4, a method 400 of operation for a mandrel is disclosed. The method 400 may comprise, at 402, dropping a restriction element to activate a downhole system and, at 404, starting a flow back of fluid within a wellbore sufficient to cause the restriction element to move toward an up-hole environment. At 406, the method 400 may also provide for compressing a spring-loaded insert placed within a second portion of the mandrel such that the restriction element passes along a diameter of the mandrel past the spring-loaded insert. At 408 the method may provide for uncompressing the spring-loaded insert placed within the second portion of the mandrel such that the restriction element returns to an uncompressed state; and at 410, the method may provide for trapping the restriction element within the second portion of the mandrel between a seat and the uncompressed spring-loaded insert.

Figure 5:
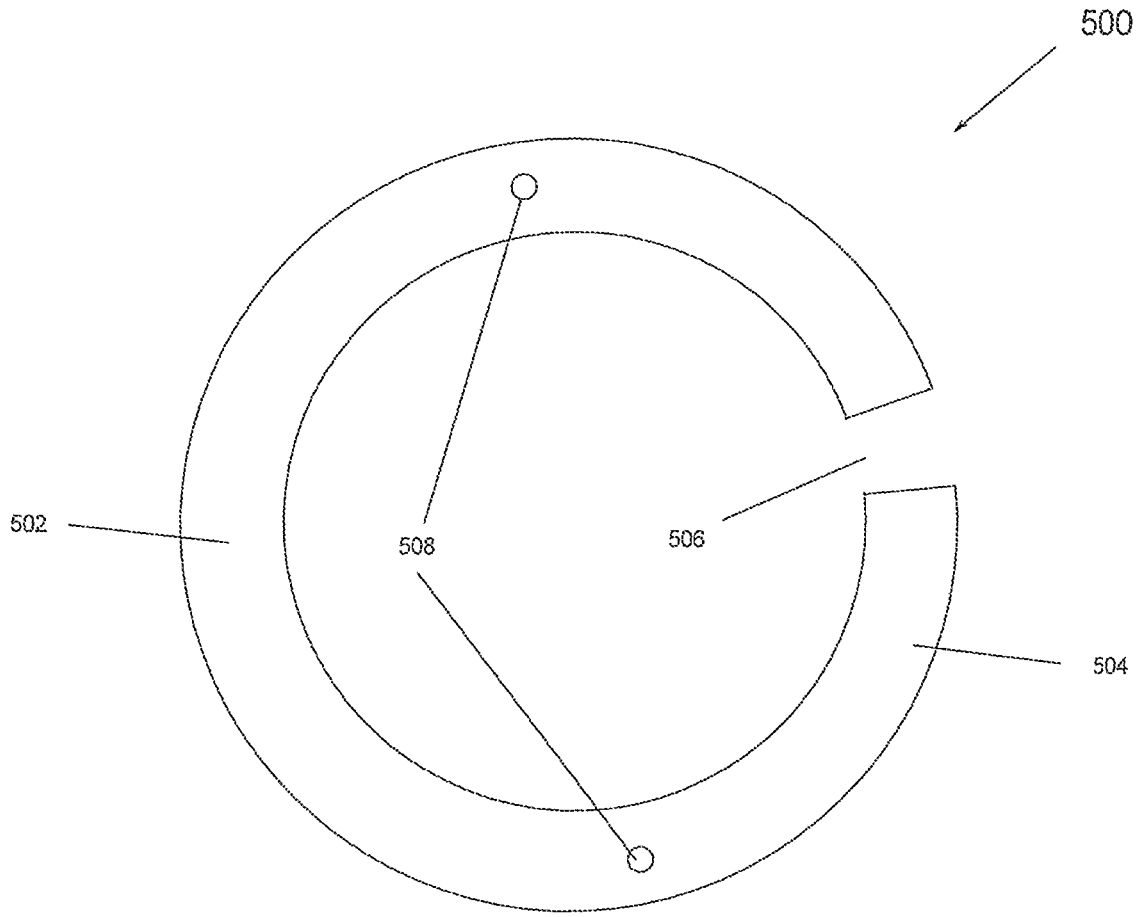
FIG. 5 is a perspective view of an anti-ball catching mechanism in one non-limiting embodiment of the disclosure.

Referring to FIG. 5, a perspective view of an anti-ball catcher mechanism 500 is illustrated. The anti-ball catcher mechanism 500 may be used when a ball is run in a place it is not desired, to accidentally catch the ball while running a plug in the wellbore. As will be understood, fluid will run through the plug inside diameter and through the setting equipment, pushing the ball towards the catcher.

In this embodiment, when the plug is stabbed up to the plug head adapter, a cone 502 collapses and restricts the ball from passing through. Once the plug is set, however, the cone 502 relaxes and the ball is able to be caught.

The anti-ball catcher mechanism 500 is provided with a shell 504 that may be a non-contiguous shell. The shell 504 may have an open volume 506 allowing the shell 504 to expand and contract. The anti-ball catcher mechanism 500 may be configured such that an attachment arrangement 508 is provided. The attachment arrangement 508 may be a single hole or a number of holes (shown with two holes) that may be used to anchor the shell 504 to a plug head adaptor.

The embodiments described above provide for many advantages that conventional apparatus do not provide. Once the plug is set and the mandrel is sheared off, the mandrel is able to catch the ball during flowback at a lower flow rate near the top of plug in a horizontal configuration if gun system does not fire. With the embodiments working perfectly. there is no need to catch the ball, pull out of hole and start fracturing. Once all stages are complete, operators may drill out all the plugs and balls. Such actions are significantly different than conventional apparatus that require higher flow rate as well as special work around procedures in order to allow for ball on seat to be recovered at surface successfully allowing a flow path for new gun systems to hydraulically be pumped in horizontal to location.

Aspects of the system and method provide many advantages compared to conventional apparatus. The apparatus and methods are easier and more reliable to operate than conventional apparatus and methods involving ball on seat systems.

Aspects of the system and method do not have the drawbacks discussed above, such as stuck balls or balls that must be drilled out from a hydrocarbon flow path..

Aspects of the system and method reduce economic costs associated with operations and apparatus described above with conventional tools and required rework with ball on seat operations.

Aspects of the system and method allow for ball recovery without the drawbacks of conventional systems and methods.

In one example embodiment, a mandrel is disclosed, comprising: a body comprising a first section, a second section, a tapered section joining the first section and the second section, wherein the first section, the second section and the tapered section are hollow and configured to accept a restriction element and a spring loaded insert placed at an angle within the second section, wherein the spring loaded insert is configured to extend from a compressed configuration to an uncompressed configuration, and wherein in the uncompressed configuration, a portion of the spring loaded insert projects into the second section such that a wellbore restriction element is retained within the second section and in a compressed configuration, the wellbore restriction element is not retained within the second section.

In another example embodiment, the mandrel may be configured wherein the insert is a spring-loaded insert.

In another example embodiment, the mandrel may be configured wherein the first section has at least four holes.

In another example embodiment, the mandrel may be configured wherein the second section has at least four holes.

In another example embodiment, the mandrel may further comprise at least one restriction element seat.

In a further embodiment, a mandrel is disclosed comprising a body comprising: a first section with at least one through hole allowing a fluid to pass from an interior of the first section to an exterior of the first section, a second section having a restriction element seat and having at least one through hole allowing a fluid to pass from an interior of the second section to an exterior of the second section, a tapered section joining the first section and the second section, wherein the first section, the second section and the tapered section are hollow and configured to accept the restriction element; and an insert placed at an angle within the second section, wherein the spring loaded insert is configured to extend from a compressed configuration to an uncompressed configuration, and wherein in the uncompressed configuration, a portion of the spring loaded insert projects into the second section such that a wellbore restriction element is retained within the second section, and in a compressed configuration, the wellbore restriction element is not retained within the second section.

In another example embodiment, a method of operation for a mandrel is disclosed comprising: dropping a restriction element to activate a downhole system; starting a flow back of fluid within a wellbore sufficient to cause the restriction element to move toward an up-hole environment, compressing a spring-loaded insert placed within a second portion of the mandrel such that the restriction element passes along a diameter of the mandrel past the spring-loaded insert; uncompressing the spring-loaded insert placed within the second portion of the mandrel such that the restriction element returns to an uncompressed state, and trapping the restriction element within the second portion of the mandrel between a seat and the uncompressed spring-loaded insert.

In another example embodiment, an apparatus is disclosed, The apparatus may comprise an arrangement configured with a central portion that is configured to allow a fluid to pass through the arrangement and wherein the arrangement is configured to be installed within a plug head adapter, wherein the arrangement is expandable from a first unexpanded position to a second expanded position.

In another example embodiment, the apparatus may be configured wherein the arrangement is configured in a cone shape.

In another example embodiment, the apparatus may be configured wherein the arrangement is configured such that the second expanded position is achieved when a plug is inserted into the plug head adapter.

In another example embodiment, the apparatus may be configured wherein the arrangement is configured such that the first unexpanded position is achieved when a plug is not inserted into the plug head adapter.

In another example embodiment, the apparatus may further comprise at least one attachment arrangement configured to attach the apparatus to the plug head adapter.

In another example embodiment, the apparatus may be configured wherein the at least one attachment includes at least one hole for connecting the arrangement to the plug head adapter.

In another example embodiment, the apparatus may be configured wherein the at least one hole is two holes.

In another example embodiment, the apparatus may be configured wherein a shell of the apparatus has a non-contiguous body portion.

In another example embodiment, the apparatus is configured to be deployed in a wellbore.

In another example embodiment, the apparatus is configured to be deployed in the wellbore through pumping of a fluid.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A mandrel for retrieving a restriction element used in connection with a hydraulic fracturing plug in a well, the mandrel comprising:

a body comprising:

a first section adapted for connection to the hydraulic fracturing plug and to receive therein the restriction element during a backflow operation toward an uphole environment of the well;

a second section also adapted to receive therein the restriction element during the backflow operation of the well;

a tapered section joining the first section and the second section, wherein the first section, the second section, and the tapered section include a hollow interior so as to permit travel of the restriction element therethrough during the backflow operation of the well; and a removable, spring-loaded insert placed through an exterior sidewall of the second section and into the hollow interior of the second section, where the insert is placed through the exterior sidewall of the second section at a non-zero angle as measured from a longitudinal axis of the second section, and where the insert is configured to extend between an uncompressed configuration and a compressed configuration while remaining at the non-zero angle, wherein the restriction element causes the insert to extend from its uncompressed configuration to its compressed configuration as the restriction element travels at least partially through the hollow interior of the second section during the backflow operation of the well, wherein in the uncompressed configuration at least a portion of the insert projects through the exterior sidewall of the second section and into the hollow interior of the second section such that the insert prevents the restriction element from moving past the insert toward a downhole environment of the well, and wherein in the compressed configuration the insert does not project into the hollow interior of the first section, the tapered section, or the second section.

2. The mandrel according to claim 1, wherein the insert is removable through the exterior sidewall of the second section.

3. The mandrel according to claim 1 wherein the insert can be repositioned to extend more or less into the hollow interior of the second section.

4. A mandrel, comprising:

a body comprising:

a first section with at least one through hole allowing a fluid to pass from an interior of the first section to an exterior of the first section;

a second section having at least one through hole allowing a fluid to pass from an interior of the second section to an exterior of the second section;

a tapered section joining the first section and the second section, wherein the first section, the second section, and the tapered section include a hollow interior configured to accept a restriction element; and a removable, spring-loaded insert placed through an exterior sidewall of the second section at a non-zero angle as measured from a longitudinal axis of the second section, wherein the insert extends from a compressed configuration to an uncompressed configuration while remaining at the non-zero angle, and wherein in the uncompressed configuration a portion of the insert projects through an interior sidewall of the second section and into the hollow interior of the second section such that the insert prevents the restriction element from moving past the insert toward a downhole environment of the well, and wherein in the compressed configuration the insert does not project into the first section, the tapered section, or the second section.

5. The mandrel according to claim 4 wherein the restriction element causes the insert to extend from its uncompressed configuration to its compressed configuration.

6. The mandrel according to claim 4 wherein the insert can be repositioned to extend more or less into the hollow interior of the second section.

7. A mandrel for retrieving a restriction element used in connection with a hydraulic fracturing plug in a well, the mandrel comprising:

a first section and a second section, wherein the first section has a connection for connecting to the hydraulic fracturing plug, and wherein the first section and the second section are hollow and configured to accept the restriction element; and a removable, spring-loaded insert placed at an angle through an exterior sidewall of the second section, wherein at least a portion of the insert moves between a compressed configuration and an uncompressed configuration while remaining at the angle, wherein in the uncompressed configuration a portion of the insert projects through an interior sidewall of the second section and into the second section such that the restriction element is prevented from moving past the insert toward a downhole environment of the well, and wherein in the compressed configuration the portion of the insert does not project through the interior sidewall of the second section and into the second section.

8. The mandrel according to claim 7 wherein the restriction element at least in part causes the portion of the insert to extend from its uncompressed configuration to its compressed configuration.

9. The mandrel according to claim 8 wherein the restriction element at least in part causes the insert to extend from its uncompressed configuration to its compressed configuration during a well flow back operation toward an up-hole environment of the well.

10. The mandrel according to claim 9 wherein the insert is removable through the exterior sidewall of the second section.

11. The mandrel according to claim 10 wherein the restriction element is a ball and wherein a separate anti-ball catcher mechanism is installed to prevent the restriction element from passing through the mandrel when the mandrel is stabbed up to the hydraulic fracturing plug and further allows the restriction element to pass through the mandrel when the hydraulic fracturing plug is set and the mandrel is no longer stabbed up to the hydraulic fracturing plug.

12. The mandrel according to claim 11 coupled to the hydraulic fracturing plug.

13. The mandrel according to claim 11 wherein the anti-ball catcher mechanism is expandable from a first unexpanded position to a second expanded position, wherein the restriction element is allowed to pass through the mandrel when the anti-ball catcher mechanism is in its first unexpanded position, and wherein the restriction element is not allowed to pass through the mandrel when the anti-ball catcher mechanism is in its second expanded position.

14. The mandrel according to claim 13 wherein the anti-ball catcher mechanism is configured in a cone shape.

15. The mandrel according to claim 7 wherein the first section includes a tapered section.

16. The mandrel according to claim 7 wherein the insert can be repositioned to extend more or less into the second section.

17. A mandrel for retrieving a restriction element used in connection with a hydraulic fracturing plug in a well, the mandrel comprising:

a first section and a second section, wherein the first section has a connection for connecting to the hydraulic fracturing plug, and wherein the first section and the second section are hollow and configured to accept the restriction element; and a removable, spring-loaded insert placed at an angle through an exterior sidewall of the second section, wherein at least a portion of the insert moves between a compressed configuration and an uncompressed configuration while remaining at the angle, wherein in the uncompressed configuration a portion of the insert projects a first distance through an interior sidewall of the second section and into the hollow interior of the second section such that a restriction element in the second section is unable to move from the second section to the first section, and wherein in the compressed configuration the insert projects a second distance through the interior sidewall of the second section and into the hollow interior of the second section such that a restriction element in the first section is able to move from the first section to the second section.

18. The mandrel according to claim 17 wherein the restriction element causes the insert to extend from its uncompressed configuration to its compressed configuration.

19. The mandrel according to claim 18 wherein the restriction element causes the insert to extend from its uncompressed configuration to its compressed configuration during a well flow back operation toward an up-hole environment of the well.

20. The mandrel according to claim 19 wherein the insert is removable through the exterior sidewall of the second section.

21. The mandrel according to claim 20 wherein the restriction element is a ball and wherein the mandrel is adapted to be used in conjunction with a separate anti-ball catcher mechanism installed to prevent the restriction element from passing through the mandrel when the mandrel is stabbed up to the hydraulic fracturing plug and further allows the restriction element to pass through the mandrel when the hydraulic fracturing plug is set and the mandrel is no longer stabbed up to the hydraulic fracturing plug.

22. The mandrel according to claim 21 coupled to the hydraulic fracturing plug.

23. The mandrel according to claim 17 wherein the insert can be repositioned to project more or less distance into the hollow interior of the second section.

24. A well mandrel for down-hole retrieval of a restriction element used in connection with a hydraulic fracturing plug, the mandrel comprising:

a body having a first end and a second end, wherein the first end has a connection for connecting to the hydraulic fracturing plug, and wherein the first end is adapted to receive the restriction element during a well backflow operation toward an up-hole environment of the well; and a removable, insert placed at an angle through an exterior sidewall of the body, wherein the insert extends between a first position and a second position while remaining at the angle, wherein in the first position the insert prevents the restriction element from moving past the insert toward a downhole environment of the well and in the second position the insert does not retain the restriction element in the body.

25. The well mandrel of claim 24 wherein the restriction element causes the insert to transition between its first position and its second position during the well backflow operation.

26. The well mandrel of claim 25 wherein the insert in its first position extends through an interior sidewall of the body and into a hollow interior of the body.

27. The well mandrel of claim 26 wherein the insert extends through the exterior sidewall of the body at a non-zero angle as measured from a longitudinal axis of the body.

28. The well mandrel of claim 27 wherein the insert is a spring-loaded insert.

29. The well mandrel of claim 28 wherein the restriction element is a ball.

30. The well mandrel of claim 29 wherein the insert in its second position does not extend into the hollow interior of the body.

31. The mandrel according to claim 24 wherein the insert can be repositioned to change the first position or the second position.

* * * * *